US008910316B2

(12) United States Patent
Albright

(10) Patent No.: US 8,910,316 B2
(45) Date of Patent: Dec. 16, 2014

(54) HEAD COVER

(76) Inventor: Angelle Albright, Covington, LA (US)

( * ) Notice: Subject to any disclaimer, the term of this patent is extended or adjusted under 35 U.S.C. 154(b) by 609 days.

(21) Appl. No.: 13/065,373

(22) Filed: Mar. 21, 2011

(65) Prior Publication Data

US 2012/0240309 A1 Sep. 27, 2012

(51) Int. Cl.
*A42B 1/04* (2006.01)

(52) U.S. Cl.
CPC ..... *A42B 1/041* (2013.01)
USPC ..... 2/204

(58) Field of Classification Search
USPC ..... 2/172, 204, 207
See application file for complete search history.

(56) References Cited

U.S. PATENT DOCUMENTS

| | | | | |
|---|---|---|---|---|
| 793,191 | A * | 6/1905 | Hancock | 2/204 |
| 833,950 | A * | 10/1906 | Yount | 2/204 |
| 932,968 | A * | 8/1909 | Cuddeback | 2/204 |
| 2,199,427 | A | 1/1938 | Dohen | |
| 2,519,512 | A | 8/1950 | Stone | |
| 4,492,242 | A | 1/1985 | Dalton | |
| 4,599,749 | A | 7/1986 | Childs et al. | |
| 5,594,956 | A | 1/1997 | Barrientos | |
| 5,790,986 | A | 8/1998 | Hall | |
| D399,993 | S | 10/1998 | Delgado | |
| D408,968 | S | 5/1999 | Bardin | |
| 6,014,776 | A | 1/2000 | DeVinzio | |
| 6,738,986 | B1 * | 5/2004 | Martin | 2/207 |
| 7,096,510 | B2 * | 8/2006 | Yeadon | 2/202 |
| D543,013 | S | 5/2007 | Robinson | |
| D627,955 | S | 11/2010 | Schrab | |
| 2006/0048277 | A1 | 3/2006 | Yeadon | |

* cited by examiner

*Primary Examiner* — Amber Anderson
(74) *Attorney, Agent, or Firm* — Keaty Law Firm, LLC

(57) ABSTRACT

An article of headwear is made of stretchable porous fabric and is configured to fit snugly over a woman's head to conceal hair loss or baldness of the user. A gathering band is stitched inside the headwear along the back portion in the area of the natural hairline to create an illusion of fullness by the folds of the fabric. A neck ruffle is created below the inner band to cover the natural hairline. An outer band is attached at two points to the outer surface to fit outside of the area where the inner band is located. The outer band has longitudinal dimensions at least slightly greater than the stretchable inner band.

2 Claims, 2 Drawing Sheets

HEAD COVER

BACKGROUND OF THE INVENTION

This invention relates generally to head covers and more particularly to a headwear for women to be worn either for reasons of fashion, tradition or while they are recovering from a partial or total hair loss.

It is known that women often wear a closely fitted head cover such as a turban or cap for reason of "fashion" and/or in adherence to observant belief systems. Another reason for wearing a head cover could be to conceal hair loss and baldness. Androgenetic alopecia or baldness in women may be caused by such factors as for instance aging and changes in the levels of androgens. Another cause for female hair loss may be a side effect of chemotherapy, which results in a substantial or total loss of hair. The hair loss due to chemotherapy treatment may last for several weeks or months during the treatment and afterward while new hair is growing.

Another side effect of the cancer treatment is that the scalp is extremely tender and overly sensitive to wigs and conventional hairpieces which may be hot, scratchy or cumbersome and require considerable care and attention. Conventional bandanas, scarves, kerchiefs, turbans, and terry cloth head covers have been tried but they are often not very attractive and require constant attention to keep them from slipping over the ears or down the forehead.

The present invention contemplates elimination of drawbacks associated with conventional head coverings and provision of a head cover that is designed to remain in a desired position on the wearer's head during use.

SUMMARY OF THE INVENTION

It is, therefore and object of the present invention to provide a head cover that can be worn by women in a variety of situations.

It is another object of the invention to provide a head cover that remains in a desired position on the wearer's head due to its closely fitted configuration.

These and other objects are achieved through a provision of an article of headwear is made of stretchable porous fabric and is configured to fit snugly over a woman's head to conceal hair loss or baldness of the user. A gathering band is stitched inside the headwear along the back portion in the area of the natural hairline to create an illusion of fullness by the folds of the fabric. A neck ruffle is created below the inner band to cover the natural hairline. An outer band is attached at two points to the outer surface to fit outside of the area where the inner band is located. The outer band has longitudinal dimensions at least slightly greater than the stretchable inner band.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
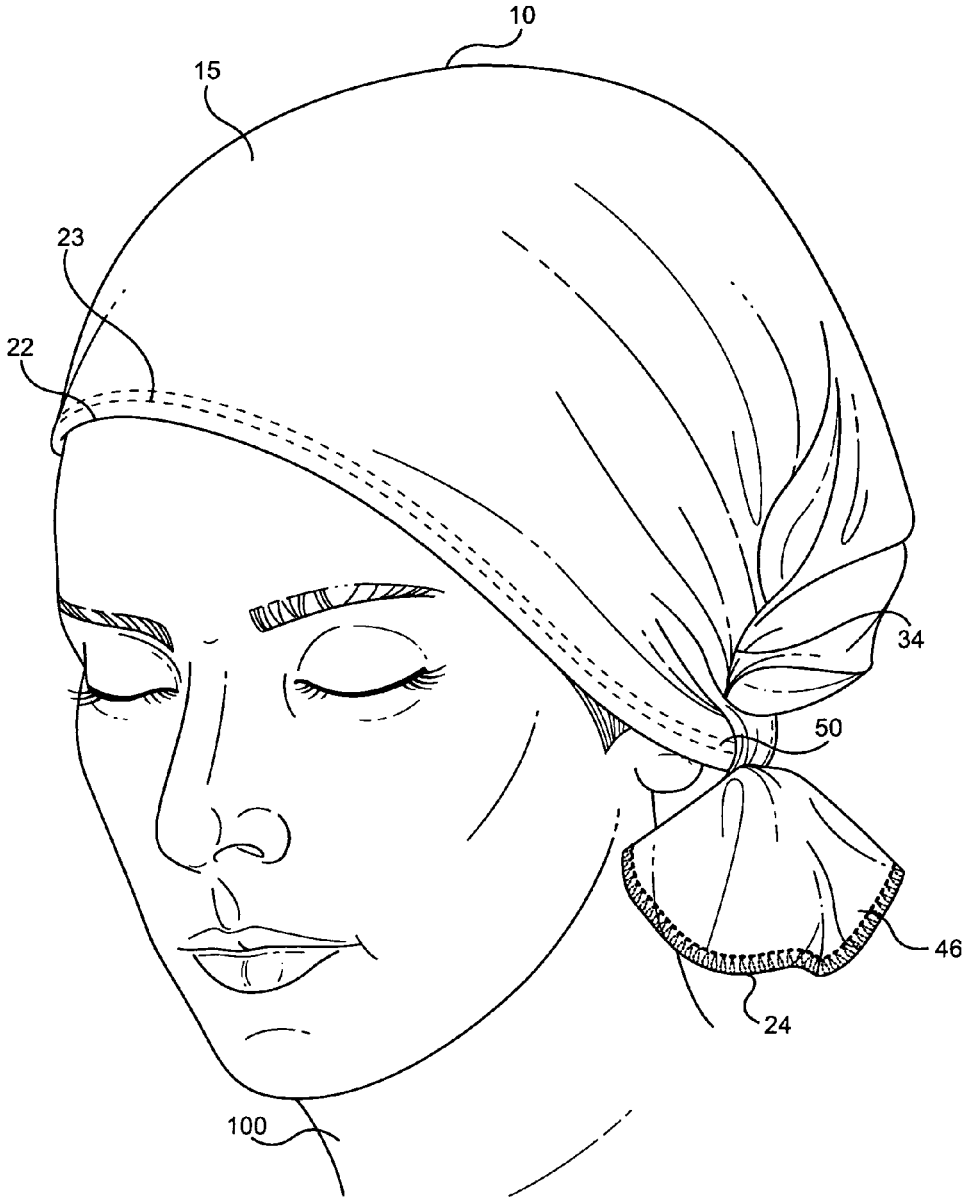
FIG. 1 is a perspective view of the head cover according to the present invention worn by a user.

Turning now to the drawings in more detail, numeral 10 designates the head cover or an article of headwear according to the present invention. The head cover 10 is designed to achieve a snug fit on the head of the wearer without requiring adjustment and maintains its snug fit on the head of the wearer during use without causing discomfort to the wearer. The head cover 10 comprises a body 12 formed from a flexible stretchable resilient material, such as for instance, Lycra, nylon blends, spandex, cotton blends, cashmere, or any other fabric, which contains and elastic-type pull to its fibers. It is preferred that the fabric be porous to allow air circulation.

The body 12 can be formed from a rectangular piece of fabric stitched to form a head-fitting headwear. The body 12 has a front portion 14, side portions 16, 18, and a back portion 20. The front portion 14 is configured to cover the user's head from the crown of the head to a level on the user's forehead below a natural hairline. The side portions 16, 18 are configured to cover the head of the user from the crown of the head to the temporal regions of the user's head. The back portion 20 is configured to extend from the crown of the user's head to below the nape of the user's head, as will be explained in more detail hereinafter. The front portion, the back portion and the side portions are integrally connected and define a common crown portion 15.

A front peripheral edge 22 extends along the front portion 14 and side portions 16, 18. A back peripheral edge 24 extends along the back portion 20. The body 12 has an inner surface 26 and an outer surface 28.

The front peripheral edge 22 is turned down to form a hem 23 by the inwardly folded front portion 14 and the side portions 16, 18. The folded hem is stitched along a seam line 30. The back peripheral edge 24 is protected by an overlock stitch that prevents fraying of the fabric. If desired, the overlock stitch can be made in a complimentary or contrasting color to provide visual interest to the head cover 10. In one of the preferred embodiments, two-thread or three-thread formations can be used to form the merrow edge hem 24.

Figure 3:
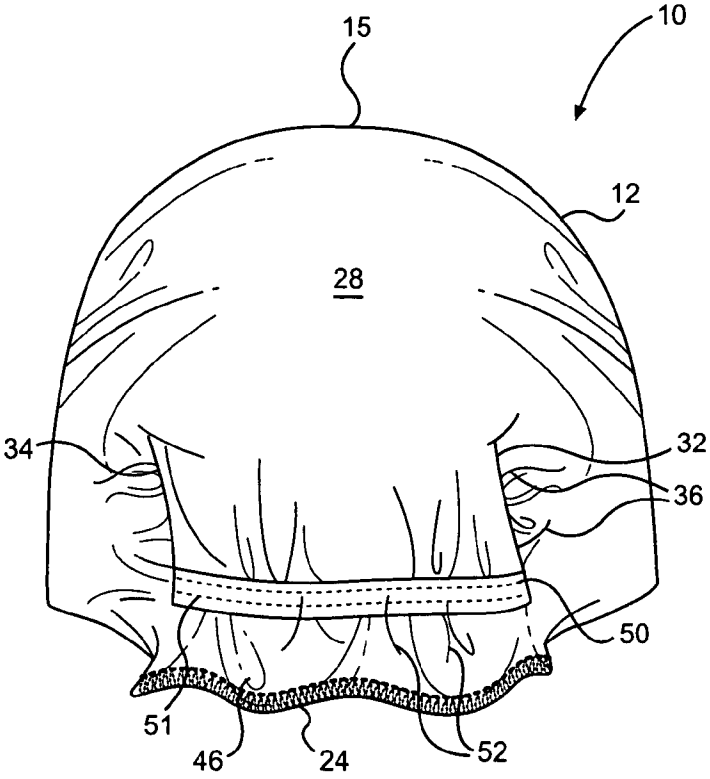
FIG. 3 is a back view of the head cover according to the present invention.

A first inner side seam 32 is made in the body 12 between the side portion 16 and the back portion 20. A second inner side seam 34 is formed in the body 12 between the side portion 18 and the back portion 20. The side seams 32 and 34 are vertically shirred, as shown in FIG. 3, to create a plurality of small horizontal gathers 36.

Figure 2:
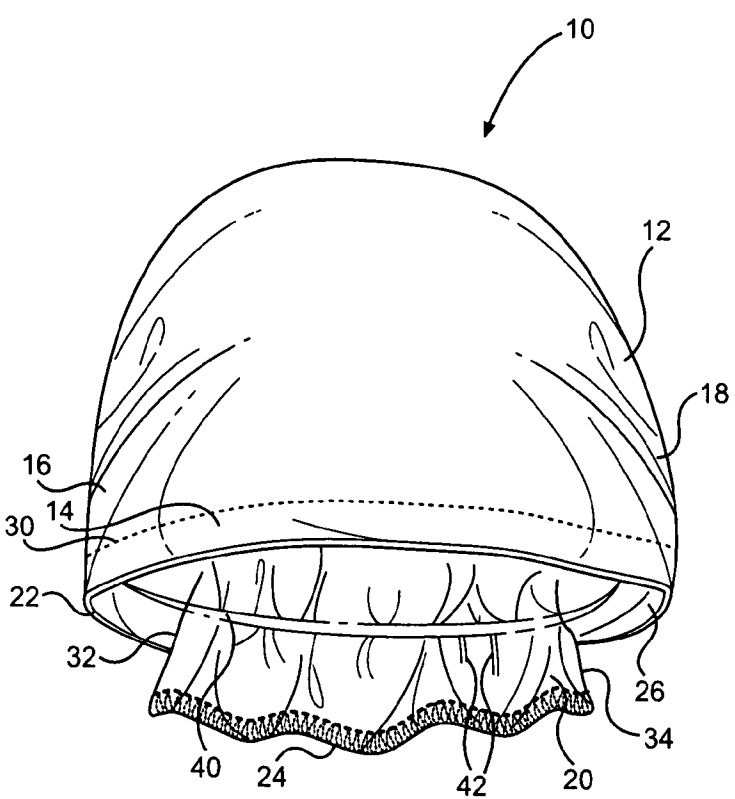
FIG. 2 is a front view of the head cover according to the present invention.

An expandable gathering inner band 40 is secured on the inner surface 26 of the body 12 a distance from the back peripheral edge 24 and transversely to the extension of the side seams 32, 34. The inner band 40, which can be made from a thin elastic band, is stitched along its entire length to the inner surface 26 of the back portion 20. The inner band 40 has opposing ends which are stitched to the body 12, while the inner band stretches approximately midway between the first side seam 32 and the second side seam 34, as can be seen in FIG. 2. The location of the side seams 32, 34 is selected to be in the area of the user's ears such that the inner band 40 is stretched horizontally across the user's head between the ears. The length of the side seams 32, 34 can be 3-4". Of course, the longer side seams, the closer the body 12 will fit around the user's head.

The inner band 40 has a predetermined longitudinal dimension or length, which in the preferred embodiment, is less than the width of the back portion 20. As a result a plurality of small folds or gathers 42 is formed at the level of the nape of the neck when a user 100 wears the head cover 10.

A neck ruffle 46 is formed between the back peripheral edge 24 and the inner elastic band 40. The neck ruffle 46 is configured to extend below the nape of the neck when worn by the user 100, as shown in FIG. 1, and cover the upper part of the user's neck.

An expandable outer band 50 is secured at two spaced-apart locations to the outer surface 28 of the body 12. The outer band 50 has a predetermined longitudinal dimension, which is at least slightly greater than the longitudinal dimension of the inner band 40. The outer band 50 is free to move and stretch separately from the back portion 20 and from the inner band 40. The outer band 50 prevents excessive stretching of the inner band 40, while the inner band creates folds or gathers 36 and 52 above and below the inner band, respectively. As a result an illusion of fullness is created by the folds 42 and 52.

In one aspect of the invention, the outer band 50 is formed from a strip of elasticized material, which is enclosed in a sleeve 51 formed from the same fabric as the fabric used for the body 12. In another aspect of the invention, the outer elastic band 50 is shirred at the ratio of 1½:1 to catch in the side seams 32, 34. Opposite ends of the outer band 50 are secured to respective side seams 32 and 34 such that the outer band 50, similarly to the inner band 40 extends transversely to the side seams 32, 34. In one of the preferred embodiments, the inner band 40 is formed from ¼" elasticized band, while the outer band 50 is formed from a fabric-covered ¾" elasticized band.

It is envisioned that the outer band 50 can have ½" to 1½" width and about 6" in length. It is envisioned that the inner band 40 can be formed from a stretchable resilient elastic 1/16" to ⅛" in width and about 6-9" in length, depending on the side of the user's head. The outer band 50 prevents the decorative flap or neck ruffle 46 from flowing freely inside and upward in relation to the body 12.

The construction of the body 12 creates a head-fitting headwear 10. The body 12 is sized such that, when the head cover 10 is fitted over the wearer's head, the body 12 forms a cap that fits snuggle without constriction or irritation on the wearer's head.

In operation, the user 100 grasps the head cover along the side portions 16 and 18 and pulls the head cover over the head. The user may adjust position of the front peripheral edge or hem 22 so that the edge extends to the desired position on the user's forehead. The user may pull the back portion 20 slightly outwardly to create an illusion of fullness at the back of the head. The ruffle 50 becomes positioned below the nape of the neck covering the natural hairline. When it touches the user's neck it creates a feeling of hair at the back of the neck, which also contributes to the comfortable feel when wearing the head cover 10.

The body 12 can be formed from one piece of fabric. The outer elastic band 50 uses a narrow rectangular piece of fabric. Alternatively the fabric covering the outer elastic band may be cut on a bias. If desired, the front peripheral hem can be decorated with artificial flowers, designs, sequins, etc.

From the above it can be seen that the present invention has the advantage of providing a relatively simple and yet attractive head cover that can be readily folded to a compact size when not in use. It can also be readily deployed from its folded position prior to being placed on the head of the user.

The terms "side", "lower", "upper", and so forth have been used herein merely for convenience to describe the present invention and its parts as oriented in the drawings. It is to be understood, however, that these terms are in no way limiting to the invention since such invention may obviously be disposed in different orientations. Many changes and modifications can be made in the design of the present invention without departing from the spirit thereof. I, therefore pray that my rights to the present invention be limited only by the scope of the appended claims.

I claim:

1. A head cover device comprising:

a body having inner and outer surfaces, and integrally formed front portion, back portion and opposing side portions;

a gathering stretchable elastic inner band secured to the inner surface a distance from a lower edge of the back portion, said inner band being configured to extend behind ears of the user across a lower part of the back portion; and a stretchable elastic outer band having opposing ends secured to the outer surface at a level generally corresponding to a level of the inner band and extending across the lower part of the back portion, said inner band and said outer band forming a neck ruffle having plurality of gathers across inner and outer surfaces of the lower part of the back portion, said neck ruffle covering a natural hairline, wherein a first side seam is formed at a junction of the side portion and the back portion and a second side seam is formed at a junction of an opposite side portion, and the back portion, and wherein the outer elastic band is shirred at a ratio of 1½:1 to catch in the side seams.

2. An article of headwear, comprising:

a body having inner and outer surfaces, and integrally formed front portion, back portion and opposing side portions, said body being formed from a porous stretchable fabric;

a gathering inner band secured to the inner surface adjacent a lower edge of the back portion, said inner band being configured to extend across a lower part of the back portion behind ears of the user and gather inner and outer surfaces of the lower part of the back portion into a plurality of folds; and a stretchable elastic outer band having opposing ends secured to the outer surface at a level generally corresponding to a level of the inner band, the outer band having a longitudinal dimension at least slightly greater than a longitudinal dimension of the inner band, said inner band and the outer band forming a neck ruffle with a plurality of gathers across inner and outer surfaces of the lower part of the back portion, said ruffle covering a natural hairline, wherein the first side seam and the second side seam extend transversely to the inner band and the outer band, and wherein the outer elastic band is shined at a ratio of 1½:1 to catch in the side seams.

* * * * *